US006697580B2

(12) United States Patent
Nakayama

(10) Patent No.: US 6,697,580 B2
(45) Date of Patent: Feb. 24, 2004

(54) IMAGE FORMING APPARATUS HAVING ERROR DETECTION OF FIXING DEVICE DEPENDING ON SET OPTIONS

(75) Inventor: Hiroshi Nakayama, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 126 days.

(21) Appl. No.: 09/998,413

(22) Filed: Dec. 3, 2001

(65) Prior Publication Data

US 2002/0067928 A1 Jun. 6, 2002

(30) Foreign Application Priority Data

Dec. 6, 2000 (JP) ..... 2000-371891

(51) Int. Cl.[7] ..... G03G 15/20
(52) U.S. Cl. ..... 399/33; 399/70
(58) Field of Search ..... 399/33, 67, 69, 399/70, 13, 88, 37, 328; 219/216

(56) References Cited

U.S. PATENT DOCUMENTS 4,897,696 A * 1/1990 Matsumoto ..... 399/33
5,794,096 A * 8/1998 Okabayashi ..... 399/33
6,035,155 A * 3/2000 Kaji et al. ..... 399/69
6,185,388 B1 * 2/2001 Yamamoto ..... 399/69
6,278,852 B1 * 8/2001 Hayashi ..... 399/88
6,349,187 B2 * 2/2002 Hayashi ..... 399/70
6,405,000 B1 * 6/2002 Nakaya ..... 399/67
6,496,665 B2 * 12/2002 Umezawa et al. ..... 399/67

FOREIGN PATENT DOCUMENTS

JP 04235612 A * 8/1992 ..... G05D/23/19
JP 6-242644 9/1994
JP 09090810 A * 4/1997 ..... G03G/15/20

* cited by examiner

*Primary Examiner*—Robert Beatty
(74) *Attorney, Agent, or Firm*—Foley & Lardner

(57) ABSTRACT

There is a method disclosed for detecting errors when supplying electric power to a heating device in an image forming apparatus that is capable of setting various options, has a coil in a heating roller, generates eddy-current in the heating roller by producing a high frequency magnetic field from the coil, and has a fixing device for fixing a developer image on a recording medium through the self-heating of the heating roller based on the eddy-current loss. This detecting method first judges comparative times to temperature arriving points at plural stages when executing the process to raise a temperature of the heating roller to a prescribed temperature based on the options that are set, applies prescribed electric power to the coil when the power source is turned ON, executes the process to raise a temperature of the heating roller to a prescribed temperature. In this process, temperatures of the heating roller are detected along the elapse of time and it is judged whether there is any error from the time elapse to the temperature arriving points at plural stages judged from the detected temperature and corresponding comparative times judged by the first judgment.

14 Claims, 9 Drawing Sheets

94a

| WUP (W) | PRE-RUN (W) | TEMPERATURE OF HEATING ROLLER (℃) | ERROR-TIME (SEC.) | | |
|---|---|---|---|---|---|
| | | | REFERENCE TIMES TAKEN UNTIL 40℃ (SEC.) | REFERENCE TIME TAKEN UNTIL 150℃ (SEC.) | REFERENCE TIME TAKEN UNTIL READY STATE 200℃ (SEC.) |
| 1300 | 1250 | T<10 | 11.2 | 40 | 36 |
| | | 10≦T≦20 | 8.8 | | |
| | | 20≦T≦30 | 6.4 | | |
| | | 30≦T≦40 | 3.9 | | |
| 1250 | 1200 | T<10 | 11.2 | 42 | 38 |
| | | 10≦T≦20 | 8.8 | | |
| | | 20≦T≦30 | 6.4 | | |
| | | 30≦T≦40 | 3.9 | | |
| 1200 | 1100 | T<10℃ | 12.0 | 44 | 40 |
| | | 10≦T≦20 | 10.0 | | |
| | | 20≦T≦30 | 7.0 | | |
| | | 30≦T≦40 | 5.0 | | |
| 1100 | 1000 | T<10 | 13.0 | 48 | 45 |
| | | 10≦T≦20 | 11.0 | | |
| | | 20≦T≦30 | 8.0 | | |
| | | 30≦T≦40 | 6.0 | | |
| 1000 | 900 | T<10 | 14.0 | 53 | 51 |
| | | 10≦T≦20 | 12.0 | | |
| | | 20≦T≦30 | 9.0 | | |
| | | 30≦T≦40 | 7.0 | | |

94a

| WUP (W) | PRE-RUN (W) | TEMPERATURE OF HEATING ROLLER (℃) | ERROR-TIME (SEC.) | | |
|---|---|---|---|---|---|
| | | | REFERENCE TIMES TAKEN UNTIL 40℃ (SEC.) | REFERENCE TIME TAKEN UNTIL 150℃ (SEC.) | REFERENCE TIME TAKEN UNTIL READY STATE 200℃ (SEC.) |
| 1300 | 1250 | T<10 | 11.2 | 40 | 36 |
| | | 10≦T≦20 | 8.8 | | |
| | | 20≦T≦30 | 6.4 | | |
| | | 30≦T≦40 | 3.9 | | |
| 1250 | 1200 | T<10 | 11.2 | 42 | 38 |
| | | 10≦T≦20 | 8.8 | | |
| | | 20≦T≦30 | 6.4 | | |
| | | 30≦T≦40 | 3.9 | | |
| 1200 | 1100 | T<10℃ | 12.0 | 44 | 40 |
| | | 10≦T≦20 | 10.0 | | |
| | | 20≦T≦30 | 7.0 | | |
| | | 30≦T≦40 | 5.0 | | |
| 1100 | 1000 | T<10 | 13.0 | 48 | 45 |
| | | 10≦T≦20 | 11.0 | | |
| | | 20≦T≦30 | 8.0 | | |
| | | 30≦T≦40 | 6.0 | | |
| 1000 | 900 | T<10 | 14.0 | 53 | 51 |
| | | 10≦T≦20 | 12.0 | | |
| | | 20≦T≦30 | 9.0 | | |
| | | 30≦T≦40 | 7.0 | | |

FIG. 3

94b

| CONNECTION WITH | | | | | WUP | | | | PRE-RUN | | | |
|---|---|---|---|---|---|---|---|---|---|---|---|---|
| RADF | FIN | FAX | PRN | ADU | — | INI | SCN | RADF | — | INI | SCN | RADF |
| — | — | — | — | — | 1300 | 1300 | 1300 | — | 1250 | 1250 | 1250 | — |
| ○ | — | — | — | — | 1300 | 1300 | 1300 | 1250 | 1250 | 1250 | 1250 | 1200 |
| — | ○ | — | — | — | 1250 | 1250 | 1250 | — | 1200 | 1200 | 1200 | — |
| ○ | ○ | — | — | — | 1250 | 1250 | 1250 | 1200 | 1200 | 1200 | 1200 | 1100 |
| — | — | ○ | — | — | 1300 | 1300 | 1300 | — | 1250 | 1250 | 1250 | — |
| ○ | — | ○ | — | — | 1300 | 1300 | 1300 | 1250 | 1250 | 1250 | 1250 | 1200 |
| — | ○ | ○ | — | — | 1250 | 1250 | 1250 | — | 1200 | 1200 | 1200 | — |
| ○ | ○ | ○ | — | — | 1250 | 1250 | 1250 | 1200 | 1200 | 1200 | 1200 | 1100 |
| — | — | — | ○ | — | 1200 | 1200 | 1200 | — | 1100 | 1100 | 1100 | — |
| ○ | — | — | ○ | — | 1200 | 1200 | 1200 | 1100 | 1100 | 1100 | 1100 | 1000 |
| — | ○ | — | ○ | — | 1100 | 1100 | 1100 | — | 1000 | 1000 | 1000 | — |
| ○ | ○ | — | ○ | — | 1100 | 1100 | 1100 | 1000 | 1000 | 1000 | 1000 | 900 |
| — | — | ○ | ○ | — | 1200 | 1200 | 1200 | — | 1100 | 1100 | 1100 | — |
| ○ | — | ○ | ○ | — | 1200 | 1200 | 1200 | 1100 | 1100 | 1100 | 1100 | 1000 |
| — | ○ | ○ | ○ | — | 1100 | 1100 | 1100 | — | 1000 | 1000 | 1000 | — |
| ○ | ○ | ○ | ○ | — | 1100 | 1100 | 1100 | 1000 | 1000 | 1000 | 1000 | 900 |
| — | — | — | — | ○ | 1200 | 1200 | 1200 | — | 1100 | 1100 | 1100 | — |
| ○ | — | — | — | ○ | 1200 | 1200 | 1200 | 1100 | 1100 | 1100 | 1100 | 1000 |
| — | ○ | — | — | ○ | 1100 | 1100 | 1100 | — | 1000 | 1000 | 1000 | — |
| ○ | ○ | — | — | ○ | 1100 | 1100 | 1100 | 1100 | 1000 | 1000 | 1000 | 900 |
| — | — | ○ | — | ○ | 1200 | 1200 | 1200 | — | 1100 | 1100 | 1100 | — |
| ○ | — | ○ | — | ○ | 1200 | 1200 | 1200 | 1100 | 1100 | 1100 | 1100 | 1000 |
| — | ○ | ○ | — | ○ | 1100 | 1100 | 1100 | — | 1000 | 1000 | 1000 | — |
| ○ | ○ | ○ | — | ○ | 1100 | 1100 | 1100 | 1000 | 1000 | 1000 | 1000 | 900 |

FIG.4

IMAGE FORMING APPARATUS HAVING ERROR DETECTION OF FIXING DEVICE DEPENDING ON SET OPTIONS

CROSS-REFERENCE TO RELATED APPLICATIONS

This application is based upon and claims the benefit of priority from the prior Japanese Patent Application No. 2000-371891, filed on Dec. 6, 2000; the entire contents of which are incorporated herein by reference.

BACKGROUND OF THE INVENTION

1. Field of the Invention

The present invention relates to an image forming apparatus that has a fixing device for fixing a developer image formed on a recording medium. A high frequency magnetic field is generated from a coil and given to a heating member to generate eddy-current, and a developer image on the recording medium is fixed through the self-heating of the heating member based on the eddy-current loss.

2. Description of the Related Art

In an image forming apparatus utilizing the digital technology; that is, a so-called digital copier, a fixing device equipped with a heating roller and a pressing roller which are in contact with each other is practically used for fixing a developer image on a sheet of paper by the heat of the heating roller while conveying a sheet of paper by clamping it between these rollers.

As an example of the heat source of the heating roller, there is an induction heating device. This induction heating device is provided with a coil accommodated in the heating roller and a high frequency generator for supplying high frequency current to this coil.

The high frequency generator is equipped with a rectifier circuit for rectifying AC voltage and a switching circuit for converting the output voltage (DC voltage) of this rectifier circuit into a prescribed high frequency. The above-mentioned coil is connected to the output terminal (the output terminal of the switching circuit) of this high frequency generator.

When the high frequency generator is operated, high frequency current is supplied to the coil and a high frequency magnetic field is generated from the coil. This high frequency magnetic field is given to the heating roller and eddy-current is generated in the heating roller. Then, the heating roller is self heated by this eddy-current loss and a developer image on a sheet of paper is fixed by this heat generation.

In the such a fixing device, a warming-up process to raise a temperature of the heating roller to a prescribed temperature when the power is turned ON and a pre-run process to make the surface temperature of the heating roller uniform by rotating the heating roller after the warming-up process is executed.

In such a fixing device, a method is proposed to judge errors according to a time lapse up to temperature arriving points at plural stages in the warming-up process when the power is turned ON.

The errors referred to here are such defects expected that a prescribed temperature is not reached within a prescribed time, a circuit board for executing the induction heating is damaged or wires are pulled out or defects of a temperature detector and thermistors, etc.

The above-mentioned digital copier is so constructed that an ADF (Automatic Document Feeder), a finisher, a FAX function, a printer function, an ADU (Auto-Duplex Unit) function can be set as options.

Further, it is proposed that the electric power to be applied to the coil is variable based on the set state of the options in the warming-up process when the power is turned ON.

So, such a copier that is capable of varying electric power to be applied to a coil according to the setting state of options in the warming-up process and a subsequent pre-run process when the power is turned ON, and setting a comparative time (an error detecting time) up to temperature arriving times at plural stages when executing the warming-up process to raise a temperature of the heating roller to a prescribed temperature when the power is turned ON is demanded.

SUMMARY OF THE INVENTION

The present invention is made in view of the above demand and its object is to provide an image forming apparatus that is capable of varying electric power to be applied to a coil based on the option setting state in a warming-up process when the power source is turned ON and a subsequent pre-run process, and setting error detecting times up to temperature arriving times at plural stages when executing the warming-up process to raise a temperature of the coil to a prescribed temperature when the power source is turned ON and the subsequent pre-run process based on the electric power applied to the coil.

According to the present invention, an image forming apparatus is provided. This image forming apparatus is capable of setting various options, has a coil in a heating roller, generates eddy-current in the heating roller by generating a high frequency magnetic field from the coil and has a fixing device to fix a developer image on a recording medium by the self heating of the heating roller based on the eddy-current loss. This image forming apparatus comprises: first judging means for judging a comparison time until the temperature reaching points at plural stages when executing the process to raise the temperature of the heating roller to a prescribed temperature when a power source is turned ON; processing means for executing the process to raise the temperature of the heating roller to a prescribed temperature by applying a prescribed electric power to the coil when the power source is turned ON; detecting means for detecting the temperature of the heating roller along the lapse of time in the processing by the processing means; and second judging means for judging whether there is any error according to a time elapsed to arrive at temperature points at plural stages judged according to detected temperature by the detecting means and a corresponding comparative time that is judged by the first judging means.

Further, according to the present invention, a method is provided for detecting errors when supplying electric power to the heating device in the image forming apparatus that is capable of setting various options and has a fixing device that has a coil in the heating roller, generates eddy-current in the heating roller by producing a high frequency magnetic field in the coil and fixes a developer image on a recording medium through the self-heating of the heating roller. This error detecting method comprises: judging a comparative time to the temperature reaching points at plural stages when executing the process to raise the temperature of the heating roller to a prescribed temperature when the power source is turned ON based on the set options; executing the process to raise the temperature of the heating roller to a prescribed temperature by applying a prescribed electric power to the coil when the power source is turned ON; detecting the temperature of the heating roller along the lapse of time when executing the process; and judging whether there is any error according to a time elapsed to the temperature arriving points at plural stages judged according to the detected temperature and a corresponding comparative time that is judged by the first judging means.

BRIEF DESCRIPTION OF THE DRAWINGS

FIG. 3 is an error detecting time setting table reserved in an HDD;

FIG. 4 is an electric power setting table reserved in the HDD;

DETAILED DESCRIPTION OF THE INVENTION

A preferred embodiment of the present invention will be explained below referring to drawings.

Figure 1:
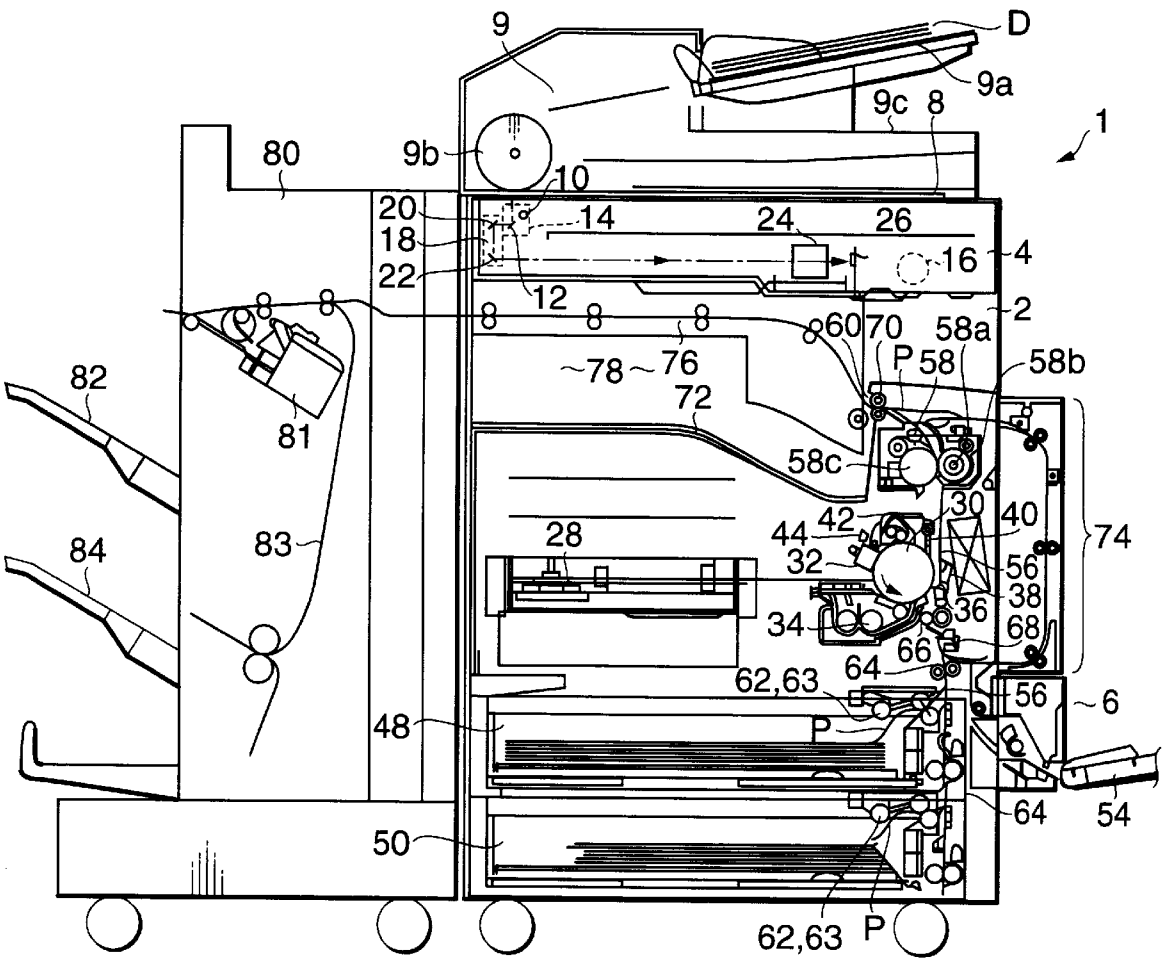
FIG. 1 is a schematic diagram showing the structure of a digital copier for explaining embodiments of this invention.

As shown in FIG. 1, such functions as an ADF (Automatic Document Feeder) function, finisher (Finisher) function, FAX function, printer function, ADU (Auto-Duplex Unit) function can be set up as optional functions (equipment) on the digital copier 1 as shown in FIG. 1. As the ADF function, a preceding input for the reading input only can be perform as the ADF function. The ADF (an automatic document feeder 9 that is described later) is installed on a document table and connected to the main body of the digital copier.

The finisher function is installed on the side of the main body of the copier and connected to the copier.

The FAX function is added to the copier when a FAX board is loaded on a motherboard of a controller.

The printer function is added when a printer FAX board is loaded on the motherboard of the controller.

The ADU function is added when an ADU controller is added to the controller.

The above functions may be preserved in a memory or a hard disc in advance as programs when adding functions. Or when the power source is turned on, by inquiring each of the units, the connected (set-up) state may be judged depending on the responses therefrom or according to switches on the boards.

As shown in FIG. 1, the digital copier 1 is equipped with the main body 2 wherein a scanner section 4 that functions as a reading means and a printer section 6 that functions as an image forming means are provided.

On the top of the main body 2, there is provided a document table 8 made of a transparent glass on which documents D that are reading objects are placed. Further, on the top of the main body 2, there is also provided an automatic document feeder 9 (hereinafter, called ADF) as a conveying means for automatically conveying documents D on the document table 8.

Documents D put on a document feed tray 9*a* of the ADF 9 are conveyed by a conveying guide (not shown) and discharged on a discharged document receiving tray 9*c* by a platen roller 9*b*. When documents D are being conveyed by the platen roller 9*b*, they are exposed to and scanned by an exposure lamp 10 of the scanner section 4, that will be described later, and images on the documents D are read.

Documents D are set on the document feed tray 9*a* of the ADF 9 with their surfaces to be read upward and taken one by one from the top document D in order.

The scanner section 4 provided in the main body 2 has an exposure lamp 10 that is composed of, for example, a xenon lamp as a light source to illuminate documents D that are conveyed by the ADF 9 or put on the document table 8 and a first mirror 12 to deflect the reflected light from documents D in a prescribed direction. The exposure lamp 10 and the first mirror 12 are mounted on a first carriage 14 that is provided below the document table 8.

The first carriage 14 is arranged movably in parallel with the document table 8 and is reciprocated under the document table 8 by a scanner motor (a driving motor) 16 via a toothed belt, etc. (not shown). The scanner motor 16 is composed of a stepping motor, etc.

Further, under the document table 8 there is provided a second carriage 18 that is movable in parallel with the document table 8. Second and third mirrors 20 and 22 that sequentially deflect reflected lights from the documents D and deflected by the first mirror 12 are mounted at a right angle to each other to the second carriage 18. The turning force is transmitted to the second carriage 18 from the scanner motor 16 via the toothed belt that drives the first carriage 14, etc. and the second carriage 18 is driven to the first carriage 14 and moved along the document table 8 in parallel with it at a speed of ½ to the first carriage 14.

Further, under the document table 8 there are provided a condenser lens 24 for focusing the reflected light from the third mirror 20 on the second carriage 18 and a CCD sensor (a line sensor) 26 for receiving the reflected light focused by the condenser lens 24 and photoelectric transferring. The condenser lens 24 is provided movably via a driving mechanism in the surface including the optical axis of the light deflected by the third mirror 22 and condenses the reflected light to a desired magnification (in the main scanning direction) by the own movement. The CCD sensor 26 transfers the incident reflected light photo-electrically according to an image processing clock given from a main CPU that is described later and outputs electric signals corresponding to read documents D. Magnification in the sub-scanning direction can be coped with by changing the conveying speed by the ADF 9 or the moving speed of the first carriage 14.

When reading the document D being conveyed by the ADF 9, the position to apply the light of the exposure lamp 10 is fixed at the reading position. Further, the position to apply the light of the exposure lamp 10 when reading the document D placed on the document table 8 is moved from the left to the right along the document table 8.

On the other hand, the printer section 6 is equipped with a laser optical device 28 that acts as a latent image forming means. A latent image is formed on the photosensitive drum 30 by scanning the surface of the photosensitive drum 30 by the laser beam from the laser optical device 28.

Further, the printer section 6 has the photosensitive drum 30 that is rotatable as an image carrier arranged at the central right side of the main body 2. The surface of the photosensitive drum 30 is exposed to the laser beam from the laser optical device 28 and a desired latent image is formed. Around the surface of the photosensitive drum 30, there are provided a main charger 32, a developing device 34, a separation charger 36, a transfer charger 38, a separation claw 49, a cleaning device 42 and a charge eliminator 44 in order. The main charger 32 charges the drum surface to a prescribed potential. The developing device 34 as a developing means develops an electrostatic latent image formed on the charged photosensitive drum 30 by the exposure of the laser optical device 28 at a desired image density by supplying a toner that is a developer. The transfer charger 38 transfers the toner image formed on the photosensitive drum 30 on a sheet of paper P that is an image forming medium supplied from cassettes 48 and 50. The separation charger 36 separates the sheet of paper P from the photosensitive drum 30. The separation claw 40 peels off the paper P from the photosensitive drum. The cleaning device 41 cleans toner remained on the surface of the photosensitive drum 30. The charge eliminator 44 eliminates the potential remaining on the surface of the photosensitive drum 30.

At the lower portion in the main body 2, the upper and lower cassettes 48 and 50 that can be pulled out of the main body are provided in the stacked state. In the cassettes 48 and 50, sheets of paper in different sizes are contained. At the side of the upper cassette 48, there is a paper manual feed tray 54.

In the main body 2, there is formed a paper conveying path 56 extending from the cassettes 48 and 50 through a transfer unit provided between the photosensitive drum 30 and the transfer charger 38. At the end of the conveying path 56, a fixing device 58 is provided. Above the fixing device 58, there is formed a discharging port 60.

The fixing device 58 is provided with a heating roller 58*b* containing an induction heating device 58*a* as a heat source and a pressing roller 58*c* in the inside. A sheet of paper P is conveyed while being clamped between these rollers and a developer image formed on the sheet of paper P is fixed by the heat of the heating roller 58*b*. After passing through the fixing device 58, a sheet of paper is discharged from the discharging port 60 by a discharge roller pair 70.

Near the upper cassette 48 and the lower cassette 50, a paper feed roller 62 for taking out copy paper P by one sheet at a time and a separation roller 63 are provided, respectively. Further, on the paper conveying path 56, many paper feed roller pair 64 are provided for conveying sheets of paper P fed by the paper feed roller 62 and taken out by the separation roller 63 through the paper conveying path 56.

In the conveying path 56, an aligning roller pair 66 is provided at the upper stream side of the photosensitive drum 30. The aligning roller pair 66 correct the tilt of a sheet of paper P that is taken out, aligns the leading edge of an toner image on the photosensitive drum 30 with the leading edge of a sheet of paper P and feeds the sheet of paper P to the transferring portion at the same speed as the moving speed of the photosensitive drum 30. To this side of the aligning roller pair, that is, at the side of the paper feed roller pair 64, there is provided a sensor 68 for detecting the arrival of a sheet of paper P.

The sheets of paper P taken out one by one from the cassettes 48 and 50 by the paper feed roller 62 are sent to the aligning roller pair 66 by the paper feed roller pair 64. Then, the paper P are sent to the transfer section after the leading edges are aligned by the aligning roller pair 66.

In the transfer section, a developer image formed on the photosensitive drum 30, that is, a toner image is transferred on a sheet of paper P by the transfer charger 38. The sheet of paper with the toner image transferred is separated from the photosensitive drum 30 by the action of the separation charger 36 and the separation claw 40 and conveyed to the fixing device 58 by way of a conveyor belt (not shown) that is a part of the conveying path 56. Then, after the developer image is melted and fixed on the paper P by the fixing device 58, the copy paper P is discharged on the paper discharging tray 72 in the main body 2 through the discharging port 60 by the discharge roller pair 70.

At the right side of the paper conveying path 56, there is provided an automatic duplex device 74 for reversing the copy paper P passed the fixing device 58 and sending again to the paper conveying path 56.

The discharging port 60 is provided with a sorting lever (not shown) for sorting copy paper P discharged from the discharging port 60 onto the discharging tray 72 or an external conveying mechanism 76. The external conveying mechanism 76 is installed in an upper cavernous part 78 on the paper discharging tray 72 in the main body 2 and conveys the copy paper P discharged from the discharging port 60 to the outside of the main body 2.

At the side of the main body 2, a finisher 80 that is an optional equipment is installed. Copy paper P (the lower side is the printed surface) conveyed by the external conveying mechanism 76 is supplied to this finisher 80.

The finisher 80 staples the trailing edge of a supplied single copy of a document (paper P) by a stapler 81 and stocks on a tray 82. The tray 82 is able to move vertically and goes down with the accumulation of the documents.

The copy paper supplied to the finisher 80 is conveyed on a reverse conveying path 83 and discharged on a tray 84 in the state with the printed surface upward.

On the front top of the main body 2, there is provided an operation panel (will be described later) that directs various copying conditions including magnification, etc. and start of copying.

Figure 2:
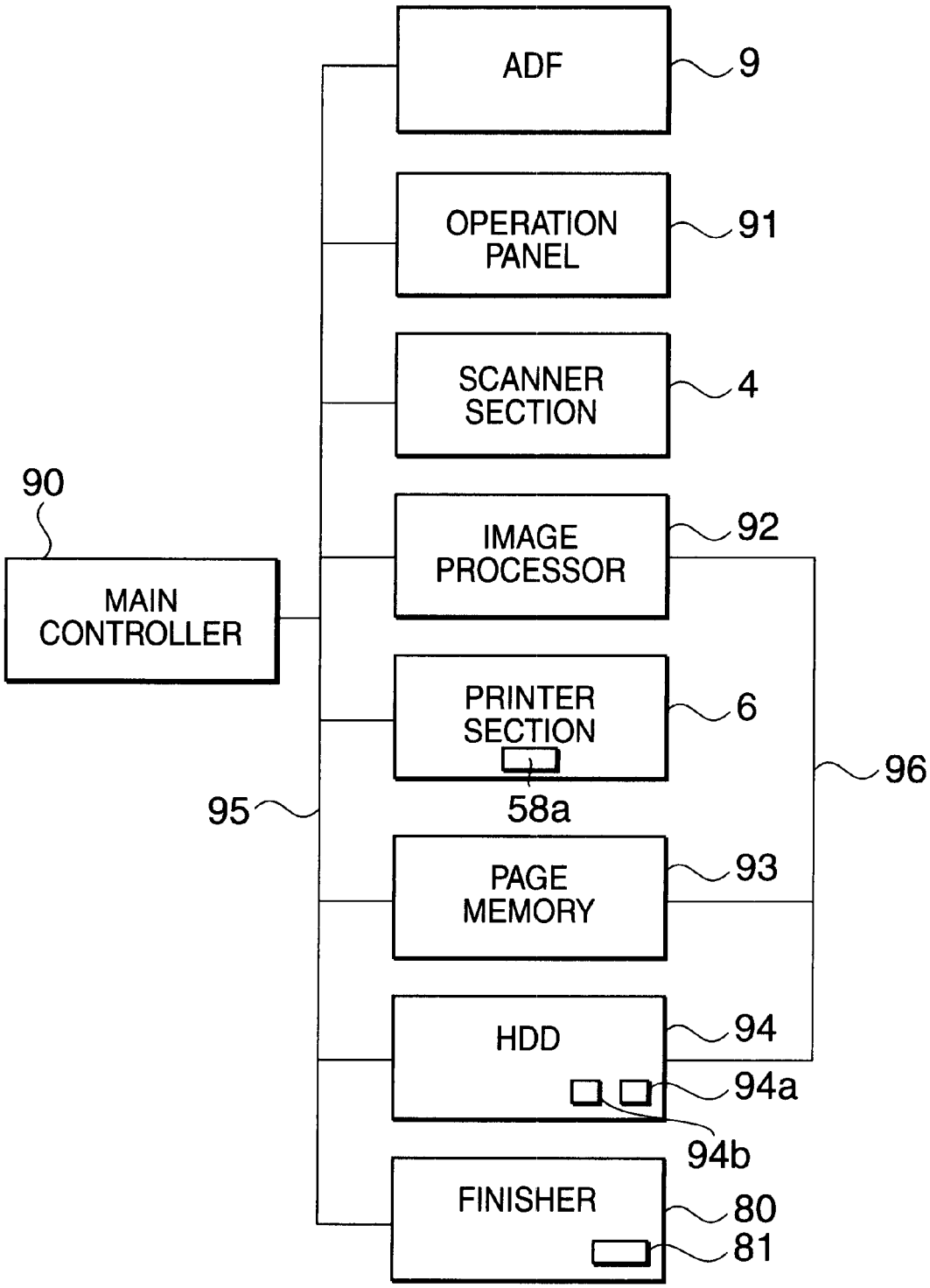
FIG. 2 is a block diagram for explaining the internal structure of a controller of the digital copier shown in FIG. 1.

The internal structure of the controller of the digital copier 1 will be explained using FIG. 2.

The digital copier 1 is equipped with a main controller 90 for controlling the entirety. This main controller 90 is composed of a CPU (Central Processing Unit) for governing the control of the operation, a ROM (Read Only Memory) for storing an operational software of the digital copier 1 and a RAM (Random Access Memory)(S-Ram) for temporarily storing image data and other operating data. These component units are however not shown, respectively.

The main controller 90 is connected with the ADF 9, the scanner section 4, the printer section 6, the finisher 80, the operation panel 91, an image processor 92, a page memory 93 and an HDD via a bus 95. Further, the image processor 92, the page memory 93 and the HDD 94 are connected via an image bus 96.

The operation panel 91 is provided on the front top of the main body 2 for directing various copying conditions including magnification, etc. and start of the copying.

The image processor 92 processes document images read by the scanner section 4, image data from the page memory 93 and the HDD 94, and outputs processed image data to the page memory 93, the printer section 6 or the HDD 94.

The image processor 92 has a compression/extension circuit (not shown) and using this compression/extension circuit, compresses image data from the page memory 93 or extends image data from the HDD 94.

The page memory 93 stores image data from the image processor 92.

The HDD 94 is an external memory represented by a hard disc to store various data. For example, when copying multiple number of sheets, the HDD 94 stores compressed read document images and reads out the compressed image for printing.

In the HDD 94, an error detecting time setting table 94*a* and an electric power setting table 94*b* are pre-set.

The error detecting time setting table 94*a* is corresponding to the connecting state of various options as shown in FIG. 3. The electric power applied to a coil 105 from the induction heating device (IH) 58*a* at the time of warming-up (WUP) process when the power source is turned ON and the electric power subsequently applied to the coil 105 from the induction heating device (IH) 58*a* at the time of pre-run (PRE-RUN), and a comparative time (the error detecting time, ERROR-TIME) to the temperature arriving points at plural stages in the warming-up process at the time of power ON and the subsequent pre-run process are correspondingly stored in the error detecting time setting table 94.

For example, the first line shows a case where no optional function is connected. The electric power at the warming-up (WUP) process is "1300W", the electric power at the pre-run (PRE-RUN) process is "1250W", the error detecting time (ERROR-TIME) at below 10° is "11.2 sec.", the error detecting time at 10–20° is "8.8 sec.", the error detecting time at 20–30° is "6.4 sec.", the error detecting time at 30–40° is "3.9 sec.", the error detecting time at 40–150° is 40 sec., and the error detecting time from 150° to the ready state is 36 sec.

The error detecting time from 150° to become the ready state is a time obtained by dividing a temperature to terminate the warming-up process (200° or 210°) from 150° by a temperature to rise in one second "1.37°" (T ready(°C./s)) plus a time (5–15 sec. variable depending on temperature) from the pre-run process after completing the warm-up process to become the ready state.

The second line is a case where any one of optional functions, for example, when the ADF 9 is connected. The electric power at the warming-up (WUP) process is "1250W", the electric power at the pre-run process is "1200W", the error detecting time for below 10 is "11.2 sec.", the error detecting time for 10–20° is "8.8 sec.", the error detecting time for 20–30° is "6.4 sec.", the error detecting time for 30–40° is "3.9 sec.", the error detecting time for 40–150° is "42 sec." and the error detecting time from 150° to become the ready state is 38 sec.

The third line is a case where any two optional functions, for example, the ADF 9 and the finisher 80 are connected. The electric power in the warming-up (WUP) process is "1200W", the electric power at the pre-run process is "1100W", the error detecting time at 10° and below is "12 sec.", the error detecting time at 10–20° is "10 sec.", the error detecting time at 20–30° is "7 sec.", the error detecting time at 30–40° is "5 sec.", the error detecting time at 40 –150° is "44 sec.", and the error detecting time from 150° to become the ready state is 40 sec.

The fourth line is a case where 3 optional functions, for example, the ADF 9, the finisher 80 and the FAX functions are connected. The electric power at the warming-up (WUP) is "1100W", the electric power at the pre-run process is "1000W" and the error detecting times at respective temperatures are shown.

The fifth line is a case where four optional functions, for example, the ADF 9, the finisher 80, the FAX function and the print function are connected. Electric power at the warming-up (WUP) process is "1000W", the electric power at the pre-run process is "900W", and the error detecting times at respective temperatures are shown.

The electric power setting table 94*b* corresponds to the connecting state of various optional functions ("0" denotes the connected, "–" denotes unconnected) as shown in FIG. 4. The electric power applied to the coil 105 by the induction heating device (IH) 58*a* at the time of power ON and the electric power applied to the coil 105 by the induction heating device (IH) 58*a* at the time of the pre-run (PRE-RUN) are correspondingly stored.

At the time of warming-up process and pre-run process, there are four states, respectively.

That is, the in preceding input by the ADF 9 (RADF), the in preceding input by the driving the scanner section 4 (the moving of the first carriage) (SCN), the in initializing operation of the scanner section 4 and the ADF 9 (the scanner section 4 only when the ADF 9 is not connected) (INI), and other operations are not carried out (–).

For example, contrary to the case where the ADF 9 only is connected as the second line optional function, at the time of the warming-up process, the electric power of "1250W" is stored during the preceding input by the ADF 9, and the electric power of "1300W" is stored for the other functions and at the time of the pre-run process, the electric power of "1200W" is stored during the preceding input by the ADF 9 and the electric power of "1250W" is stored for other functions.

The main controller 90 has an input task and a print task that are controlled for every job.

Figure 5:
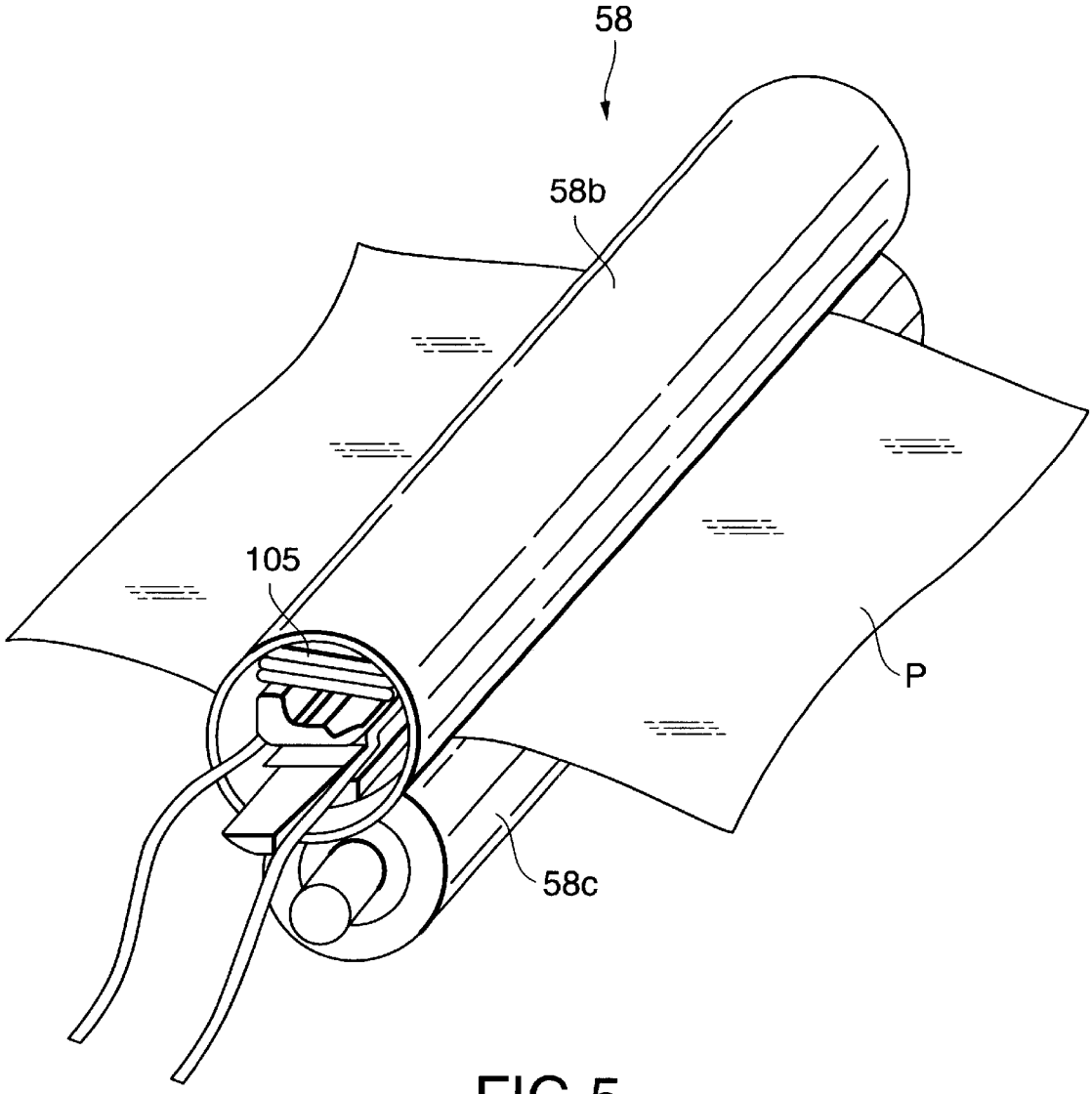
FIG. 5 is a rough perspective view showing a fixing device incorporated in the digital copier shown in FIG. 1.
Figure 6:
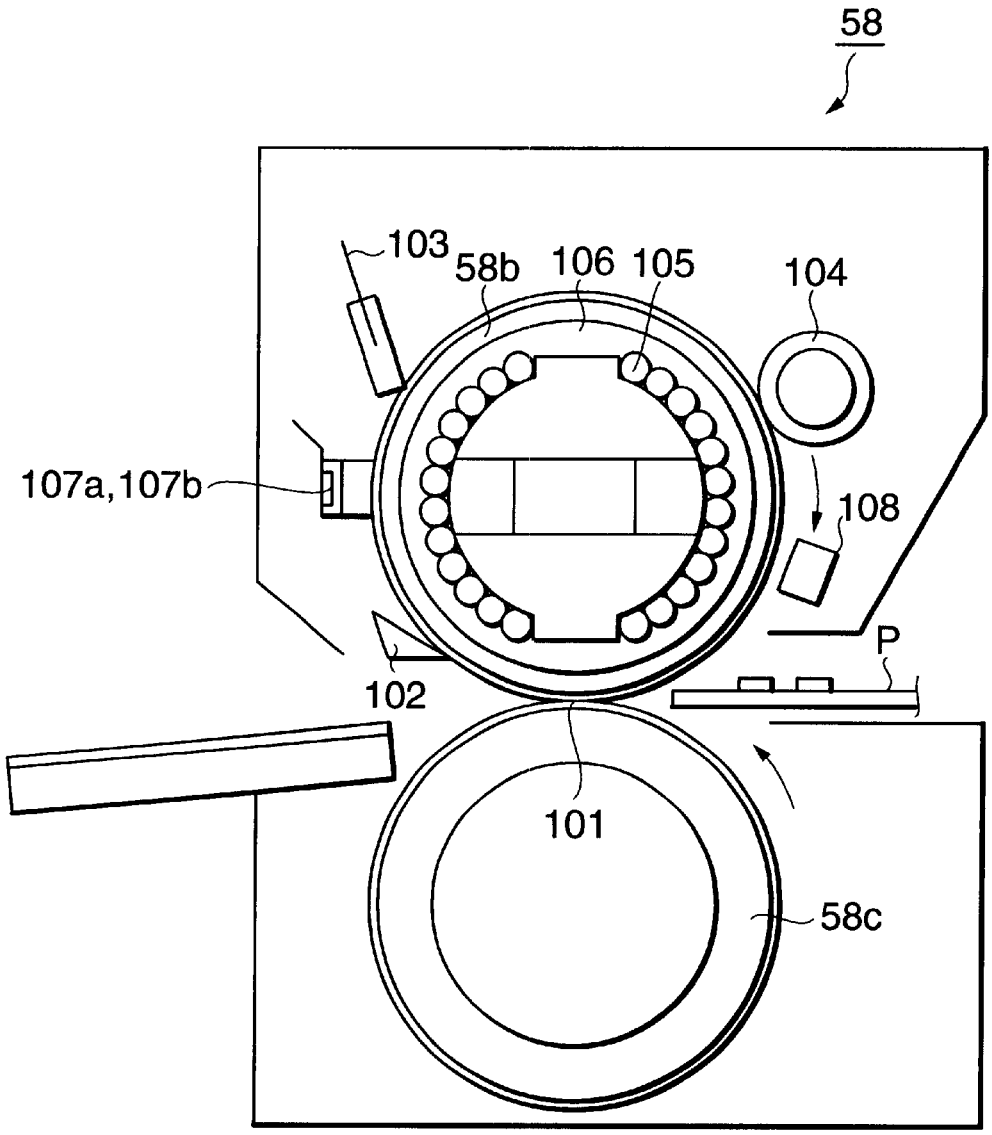
FIG. 6 is a schematic sectional view showing the fixing device shown in FIG. 5.

As shown in FIG. 5 and FIG. 6, the fixing device 58 is composed of the heating (fixing) roller 58*b* and the pressing (press) roller 58*c*.

The heating roller 58*b* is driven in the arrow direction by a driving motor (not shown). Further, the pressing roller 58*c* is rotated in the arrow direction following the heating roller 58*b*. Further, a sheet of paper P carrying a toner image T to be fixed passes between these rollers.

The heating roller 58*b* is an endless member having a metallic layer composed of, for example, a 1 mm thick iron made cylinder, that is a conductor with a mold releasing layer of Teflon, etc. formed on the surface. Further, stainless steel, aluminum, alloy of stainless steel and aluminum, etc. are usable for the heating roller 58*b*.

The pressing roller 58*c* is made of a core metal coated with such elastic materials as silicon rubber, fluoro rubber and press fitted to the heating roller 58*b* by the pressing mechanism (not shown) at a prescribed pressure and provides the nip in a prescribed width (the outer surface of the pressing roller 58*c* is elastically deformed by the press fitting) 101 at the position where both rollers come into contact with each other.

Thus, when a sheet of paper P passes the nip 101, a toner on the paper P is fused and fixed thereon.

On the surface of the heating roller 58*b* and at the downstream side in the rotary direction from the nip 101, there are a separation claw 102 for separating a sheet of paper P from the heating roller 58*b*, a cleaning member 103 for removing toners offset transferred on the outer surface of the heating roller 58*b*, paper powder generated from paper, a surface lubricant coating device 104 for coating a surface lubricant in order to prevent toner from adhering to the outer surface of the heating roller 58*b*, thermistors 107*a* and 107*b* for detecting temperatures of the outer surface of the heating roller 58*b* and a thermostat 108 for stopping supply of electric power by opening the contact when the temperature rises above a prescribed temperature.

In the inside of the heating roller 58*b*, an excitation coil 105, composed of a litz wire that is a bundle of plural insulated copper wires, for example, in 0.5 mm diameter is provided as a magnetic field generating means. When the excitation coil is made of a litz wire, it becomes possible to make a wire diameter small rather than the skin depth and high frequency current can be applied efficiently. Further, in the embodiment shown in FIG. 5, a litz wire made of 19 wire rods in 0.5 mm diameter bundled and covered by a heat resisting polyamide is used for the excitation coil 105.

The excitation coil 105 is an air-coil without using a core material (for example, ferrite, iron core, etc.). As the excitation coil 105 is made an air-coil, it becomes unnecessary to use core material in complicate shapes and cost can be reduced. Further, the excitation circuit also becomes cheap.

The excitation coil 105 is supported by a coil support member 106 that is formed with heat resisting resin (for example, highly heat resisting industrial plastic).

The coil support member 106 is positioned between the heating roller 58*b* and a structural member (a sheet metal) (not shown) that is holding the heating roller 58*b*.

The excitation coil 105 generates magnetic flux and eddy-current in the heating roller 58*b* so as to prevent the change in the magnetic field by magnetic flux generated by high frequency current from an excitation circuit (an inverter circuit) (not shown). Joule heat is generated by this eddy-current and specific resistance of the heating roller 58*b* and heats the heating roller 58*b*. In this embodiment, high frequency current of 25 kHz and 90W flows through the excitation coil 105.

Figure 7:
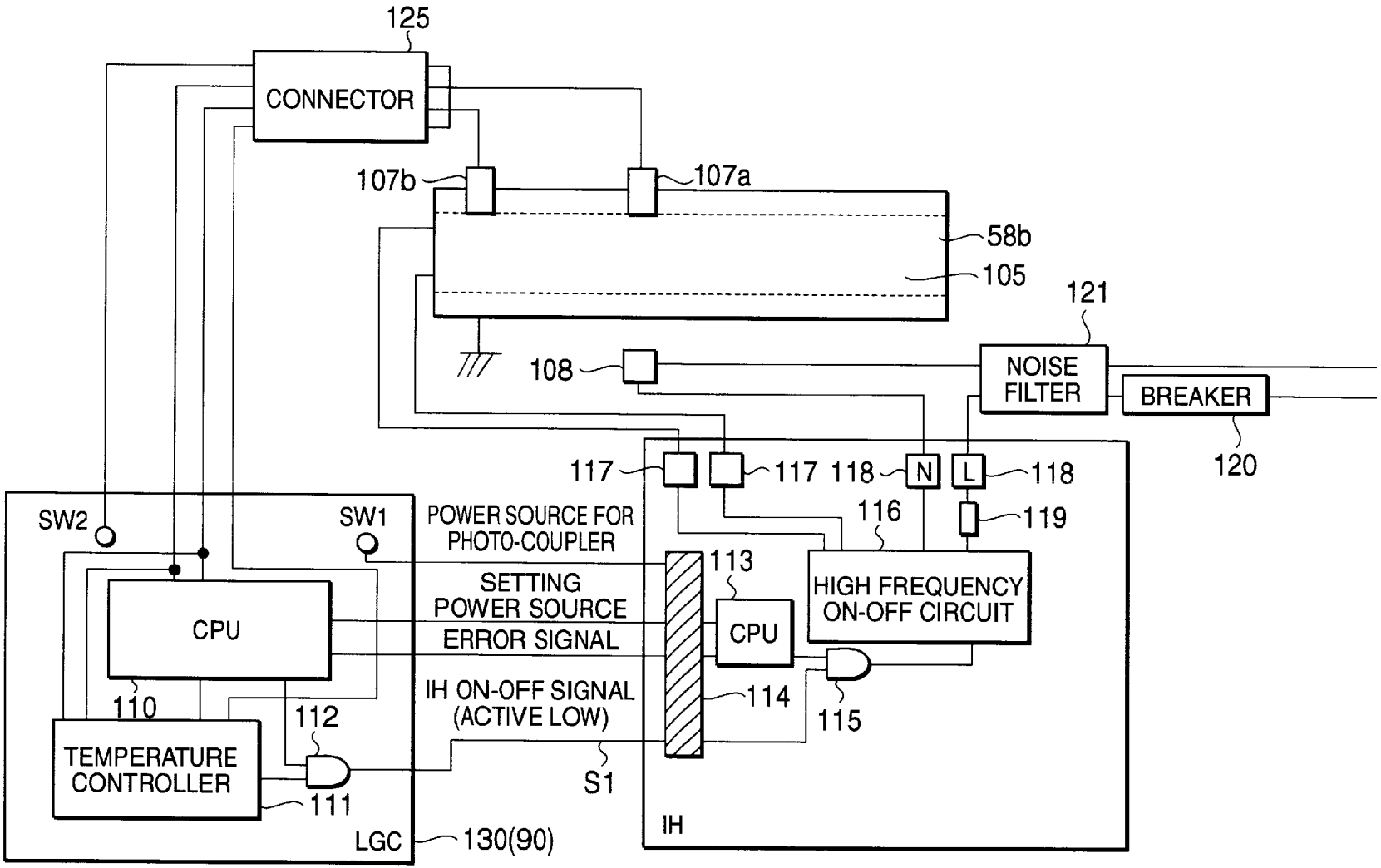
FIG. 7 is a block diagram showing a controller that is connected to a hearing roller of the fixing device shown in FIG. 7.

Next, a controller for the heating roller 58*b* will be explained using FIG. 7.

That is, the controller is composed of a main body side circuit board (or a board for the fixing device) 130 of the main controller 90 and an induction heating device side circuit board 131 for the induction heating device (IH) 58*a*.

On the main body side circuit board 130, there are arranged a CPU 110 as a control element, a temperature controller 111, and AND circuit 112 and switches for applying electric power SW1 and SW2.

The temperature controller 111 outputs IH signal to the AND circuit 112 based on the control signal from the CPU 110 and temperature of the heating roller 58*b*. Detecting signals are supplied to the temperature controller 111 from the thermistors 107*a* and 107*b* via a connector 125 outside the circuit board 130 and a control signal is supplied from the CPU 110 based on the current operating state.

The CPU 110 outputs an electric power setting signal to the induction heating device 58*a* based on the current operating state, a control signal to the temperature controller 111 based on the current operating state, and an enabling signal to the AND circuit 112 based on presence of an error signal and temperature of the heating roller 58*b*. To the CPU 110, detecting signals are supplied from the thermistors 107*a*, 107*b* and an error signal are supplied from the induction heating device 58*a* via the connector 125 outside the circuit board 130.

When an enabling signal is supplied from the CPU 110, the AND circuit 112 outputs an IH ON signal from the temperature controller 111 to the induction heating device 58*a*.

The SW1 is connected to a photo-coupler 114 that will be described later via a signal line and applies electric power to the photo-coupler 114.

The SW2 is connected to the connector 125 via the signal line and applies electric power to the connector 125.

On the induction heating device side circuit board 131, a CPU 113 as a control element, the photo-coupler 114, an AND circuit 115, a high frequency On-Off circuit 116 as a high frequency generator, output ports 117 and 117, input ports 118 and 118, and a fuse 119 are arranged.

The photo-coupler 114 is for exchanging signals without contact. To the photo-coupler 114, 5V photo-coupler electric power is supplied from the switch SW1 of the circuit board 130, the electric power setting signal from the CPU 110 of the circuit board 130 is supplied and the IH signal from the AND circuit 112 via the signal line respectively. The photo-coupler 114 outputs an error signal from the CPU 113 to the CPU 110 on the circuit board 130 via the signal line.

The photo-coupler 114 outputs the supplied electric power setting signal on non-contract and outputs the supplied IH signal to the CPU 113 and the AND circuit 115 on non-contact.

The CPU 113 is to control the driving of the high frequency On-Off circuit, and controls the driving of the high frequency On-Off circuit based on the supplied electric power setting signal and judges various errors and outputs error signals based on this judgment.

The CPU 113 outputs the IH ON signal to the AND circuit 115 based on the IH ON signal supplied from the photo-coupler 114 when no error is generated.

The AND circuit 115 outputs the IH on signal to the high frequency On-Off signal circuit 116 when the IH ON signal from the CPU 113 and the IH ON signal from the photo-coupler 114 are supplied simultaneously.

The high frequency On-Off circuit 116 applies the electric power that is set by the CPU 113 to the excitation coil 105 via the output ports 117 and 117 when the IH ON signal is supplied from the AND circuit 115.

At this time, a high frequency magnetic field is generated from the excitation coil 105 when high frequency current is supplied to the coil 105 from the high frequency On-Off circuit 116. This high frequency magnetic field generates the eddy-current in the coil 105 and the heating roller 58*b* is self-heated based on the eddy-current loss by the eddy-current and resistance of the heating roller 58*b*.

To the input ports 118 and 118, AC power from the plug socket (not shown) is supplied via a breaker 120, a noise filter 121 and the thermostat 108. A fuse 119 is provided to one of the input ports 118. AC power supplied via the input ports 118 and 118 is supplied to the units on the induction heating device side circuit board 131.

On the induction heating device side circuit board 131, a rectifier circuit (not shown) for rectifying commercial AC electric power and a constant voltage circuit to output the output voltage of this rectifier circuit by regulating to a constant level suited for the operation of the CPU 113 are provided.

Figure 8:
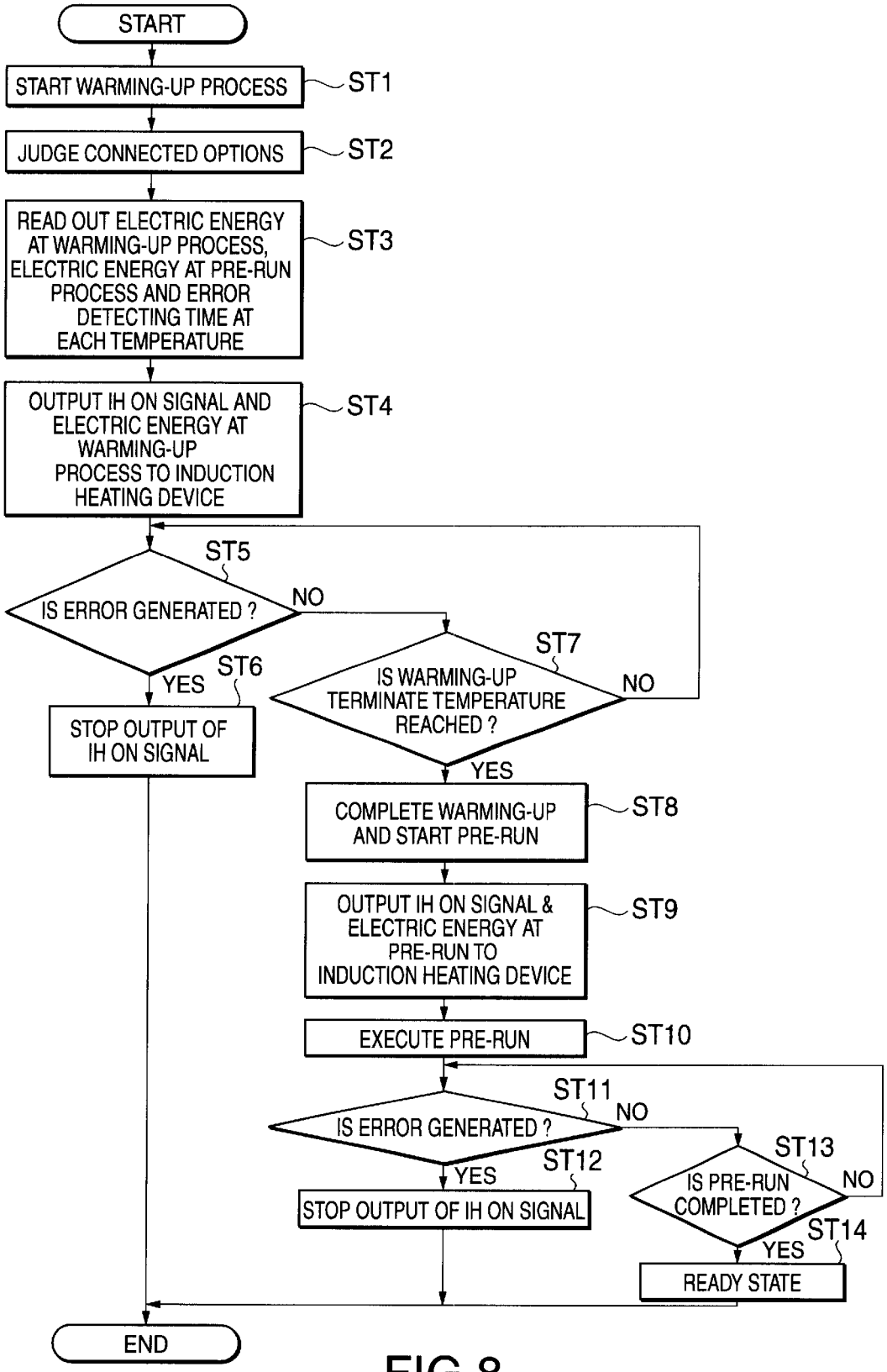
FIG. 8 is a flowchart for explaining a warming-up process and a pre-run process.

Next, the warming-up process and the pre-run process based on the set contents of the error detecting time setting table 94*a* in the structure described above will be explained referring to a flowchart shown in FIG. 8.

Further, errors are expected to be such that a prescribed temperature is not reached within a prescribed time and a circuit board for induction heating is broken or wiring is pulled out, temperature sensors are defective.

For example, when the power switch (not shown) is turned ON, the main controller 90 judges the start of the warming-up process (ST1) and makes an inquiry to connected equipment or judges connected options based on the status of various switches (ST2). Then, based on the connected options, the main controller 90 reads out the electric power at the warming-up (WUP) process, the electric power at the pre-run process and error detecting times at respective temperatures from the error detecting time setting table 94*a* (ST3).

Then, the main controller 90 outputs the IH ON signal and the above read electric power at the warming-up process to the induction heating device 58*a* (ST4). When high frequency current is supplied to the coil 105 from this induction heating device 58*a*, a high frequency magnetic field is generated from the coil 105. By this high frequency magnetic field, eddy-current is generated in the heating roller 58*b* and the heating roller 58*b* is self heated based on the eddy-current loss by eddy-current and resistance of the heating roller 58*b*.

Under this state, the main controller 90 judges whether any error is generated based on the surface temperature sensed result of the heating roller 58*b* by the thermistors 107*a* and 107*b* and the time elapsed from when the output of the IH ON signal is started (ST5). As a result, when any error is judged, the main controller 90 stops the output of the IH ON signal (ST6). When the supply of high frequency current to the coil 105 by the induction heating device 58*b* is interrupted and the heating of the heating roller 58*b* is stopped.

When no error is judged but it is judged that the surface temperature of the heating roller 58*b* reaches the warming-up complete temperature by the thermistors 107*a*, 107*b* (ST7), the main controller 90 judges the start of the pre-run (ST8).

Then, the main controller 90 outputs the read electric power at the time of the pre-run process while outputting the IH ON signal to the induction heating device 58*a* (ST9). When the high frequency current is newly supplied to the coil 105 from by the induction heating device 58*a*, the high frequency magnetic field is generated in the heating roller 58*b* and the eddy-current is generated in the heating roller 58. The heating roller 58*b* is self heated based on the eddy-current loss by the eddy-current and the resistance of the heating roller 58*b*.

Under this state, the main controller 90 rotates the hearing roller 58*b* of the fixing device 58 and executes the pre-run process to unify the entire surface temperature by the heating roller 58*b* (ST10).

Further, the main controller 90 judges whether there is any error generated based on to the surface temperature of the heating roller 58*b* detected by the thermistors 107*a* and 197*b*, a time elapsed from starting the output of the IH ON signal and an error detecting time to become the ready state read (ST11).

When any error is judged as a result, the main controller 90 stops the output of the IH ON signal (ST12). As a result, the supply of high frequency current to the coil 105 by the induction heating device 58*a* is interrupted and the heating of the heating roller 58*b* is stopped.

When no error is judged and the completion of the pre-run process is judged in the above Step 11 (ST13), the main controller 90 becomes the ready state at the time when the pre-run process is completed and other initial processes are completed (ST14).

As described above, the electric power to the induction heating device 58*b* is increased/decreased according to the connecting state of the options. The more the electric power is large, the less the error detecting time becomes short because the surface of the fixing device 58, that is, the heating roller 58*b* is easily warmed up, and the less the electric power is small, the more the error detecting time becomes longer because it is difficult to warm up the surface of the fixing device 58, that is the heating roller 58*b*.

Further, because the electric power setting is switched for the warming-up process and the pre-run process, it is possible to set the error detecting time by considering rotation and stopping.

Figure 9:
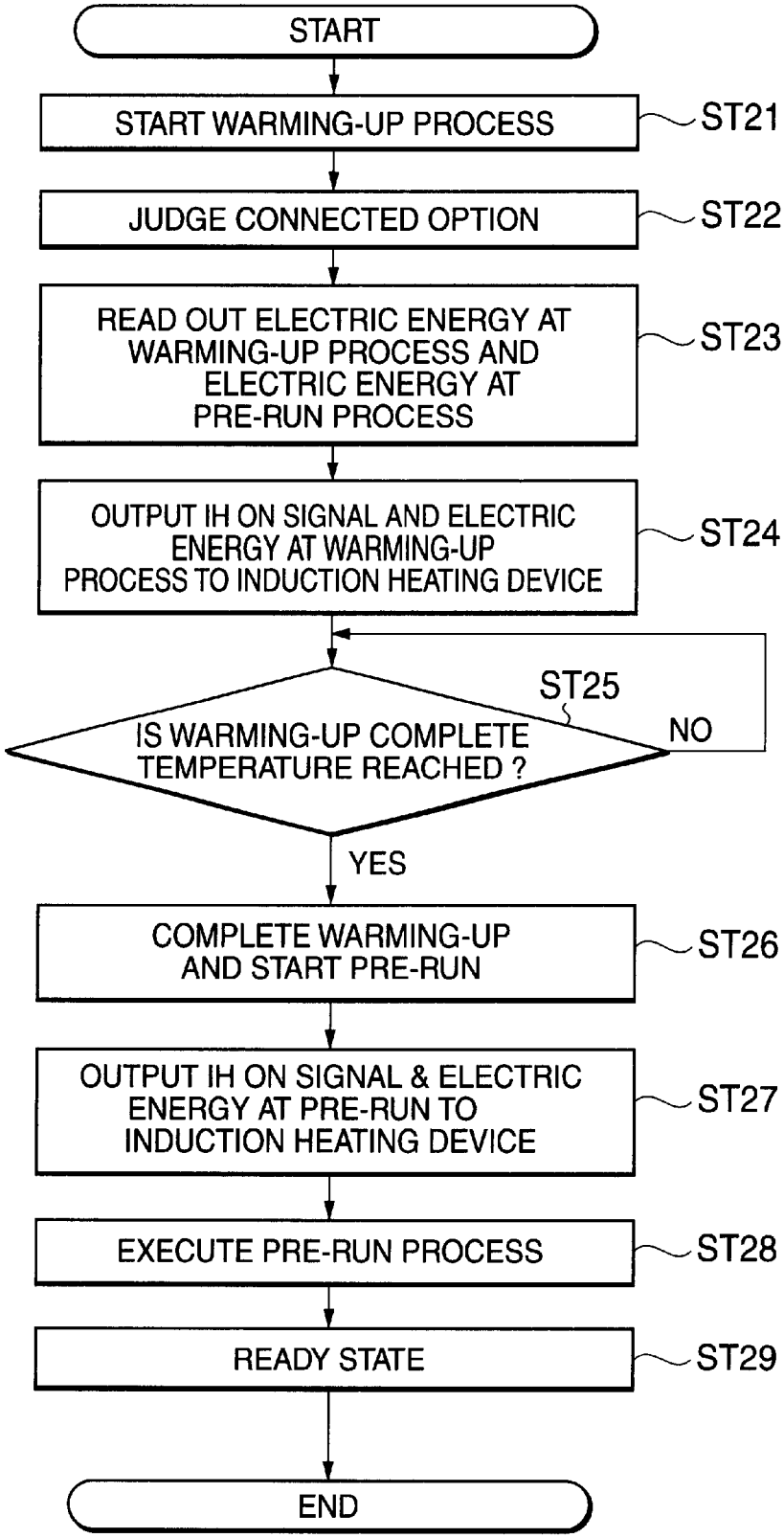
FIG. 9 is a flowchart for explaining the warming-up process and the pre-run process.

Next, the warming-up process and the pre-run process based on the set contents of the electric power setting table 94*b* in the structure described above will be explained referring to a flowchart shown in FIG. 9.

Now, for example, when the power switch (not shown) is turned ON, the main controller 90 judges the start of the warming-up process (ST21), makes the inquiry to connected equipment and judges connected options based on the state of various switches (ST22). Then, based on the connected options, the main controller 90 reads out the electric power at the time of the warming-up (WUP) process and that of the pre-run process from the electric power setting table 94*b* (ST23). For example, when the ADF 9 and the finisher 80 are connected, the electric power "1250W" in the warming-up process, "1200W" the pre-run process, and "1200W" in the warming-up process and "1100W" in the pre-run process for the preceding input by the ADF 9 are read out.

As a result, the main controller 90 outputs the IH ON signal and the read out electric power at the time of the warming-up (WUP) process to the induction heating device 58*a* (ST24). When high frequency current is applied to the coil 105 by the induction heating device 58*a*, a high frequency magnetic field is generated from the coil 105 and this high frequency magnetic field generates eddy-current in the heating roller 58*b*, which is then self heated based on the loss of eddy-current by the eddy-current and the resistance of the heating roller 58*b*.

When the preceding input is directed by the ADF 9 at this time, the electric power for the preceding input is set.

Under this state, the main controller 90 judges the completion of the warming-up and the start of the pre-run (ST26) when judged that the surface temperature of the heating roller 58*b* by the thermistors 107*a* and 107*b* reached the final temperature of the warming-up (ST25).

Then, the main controller 90 outputs the read electric power at the time of the pre-run process while outputting the IH ON signal to the induction heating device 58*a* (ST27). The induction heating device 58*a* newly supplies high frequency current to the coil 105 and a high frequency magnetic field is generated from the coil 105. This high frequency magnetic field generates eddy-current in the beating roller 58*b* and the heating roller 58*b* is self heated based on the eddy-current loss by the eddy-current and the resistance of the heating roller 58*b*.

Under this state, the main controller 90 rotates the heating roller 58*b* of the fixing device 58 and executes the pre-run process to unify the entire surface temperature (ST28).

Further, when judges the completion of the pre-run process, the main controller 90 becomes the ready state at the time when other initial processes are completed (ST29).

Next, the process when the induction heating device 58*a* is turned ON by the main controller 90 and high frequency current is supplied to the coil 105 will be explained referring to the circuit diagram in FIG. 7.

Now, for example, the IH ON signal is output from the temperature controller 111 based on the control signal from the CPU 110 at the circuit board 130 side and the temperature of the heating roller 58*b*. At this time, when the CPU 110 does not judge any error, the enabling signal is supplied to the AND circuit 112. Then, the IH ON signal is supplied to the photo-coupler 114 on the induction heating device side circuit board 131 via the AND circuit 112 and a signal line S1.

The photo-coupler 114 outputs the IH ON signal supplied via the signal line S1 to the CPU 113 and also, to the AND circuit 115. When no error is generated, the CPU 113 outputs the IH ON signal to the AND circuit 115 based on the IH ON signal supplied from the photo-coupler 114.

As a result, when the IH ON signal from the CPU 113 and the IH ON signal from the photo-coupler 114 are supplied simultaneously, the AND circuit 115 outputs the IH ON signal to the high frequency On-Off circuit 116. By the IH ON signal supplied from the AND circuit 115, the high frequency On-Off circuit 116 applies the electric power that is set by the CPU 113 to the coil 105 via the output ports 117 and 117.

Thus, when high frequency current is supplied to the coil 105 from the high frequency On-Off circuit 116, the high frequency magnetic field is generated in the coil 105. This high frequency magnetic field generates eddy-current in the heating roller 58*b* and the heating roller 58*b* is self heated based on the eddy-current loss by the eddy-current and the resistance of the heating roller 58*b*.

Accordingly, while a sheet of paper P is conveyed by clamping it between both of these heating roller 58*b* and pressing roller 58*c*, a developer image on the sheet of paper P is fixed by the heat of the heating roller 58*b*.

As described above in detail, according to the present invention, it is possible to provide an image forming apparatus that is capable of varying electric power to be applied to a coil based on the setting state of options in the warming-up process at the time when the power source is turned ON and in the subsequent pre-run process and is also capable of setting error detecting times until temperature points are reached at plural stages in the warming-up process to raise a temperature to a prescribed temperature when the power source is turned ON and the subsequent pre-run process based on the electric power applied to the coil can be provided.

What is claimed is:

1. An image forming apparatus that is capable of setting various options, has a coil in a heating roller, generates eddy-current in the heating roller by generating a high frequency magnetic field from the coil and has a fixing device to fix a developer image on a recording medium by the self heating of the heating roller based on the eddy-current loss, comprising:

storing means for pre-storing electric power data corresponding to electric power being applied to the coil that are different corresponding to the set state of various options and pre-storing reference times until temperature arriving points at plural stages that are different corresponding to the set state of various option;

reading means for reading out from the storing means the electric power data corresponding to the electric power being applied to the coil and the reference times until the temperature reaching points at plural stages when executing the process to raise the temperature of the heating roller to a prescribed temperature when a power source is turned ON based on the set option;

processing means for executing the process to raise the temperature of the heating roller to a prescribed temperature by applying the electric power to the coil when the power source is turned ON, wherein the electric power corresponds to the electric power data read out from the storing means by the reading means based on the set option;

detecting means for detecting the temperature of the heating roller along with the lapse of time in the processing by the processing means; and judging means for judging presence of error by comparing a time elapsed to the temperature arriving points at plural stages judged according to detected temperature by the detecting means and the reference times that are read out from the storing means by the reading means.

2. The image forming apparatus according to claim 1, wherein the processing means correspond to the warming-up process to raise the temperature of the heating roller to a prescribed temperature when the power source is turned ON or the warming-up process to raise the temperature of the heating roller to a prescribed temperature when the power source is turned ON and the pre-run process to rotate the heating roller after the warming-up process.

3. An image forming apparatus that is capable of setting various options, has a coil in a heating roller, generates eddy-current in the heating roller by generating a high frequency magnetic field from the coil and has a fixing device to fix a developer image on a recording medium by the self heating of the heating roller based on the eddy-current loss, comprising:

storing means for pre-storing electric power data corresponding to electric power being applied to the coil when executing warming-up processes that are different corresponding to the set state of various options and pre-storing reference times until temperature arriving points at plural stages when executing warming-up processes that are different corresponding to the set state of various options;

first reading means for reading out from the storing means the electric power data corresponding to the electric power to be applied to the coil when executing the warming-up process to raise the temperature of the heating roller to a prescribed temperature when a power source is turned ON based on the set options;

second reading means for reading out the reference times until the temperature arriving points are reached at plural stages when executing the warming-up process to raise the temperature of the heating roller to a prescribed temperature when the power source is turned on based on the set options;

processing means for executing the warming-up process to raise the temperature of the heating roller to a prescribed temperature by applying the electric power corresponding to the electric power data read out from the storing means when the power source is turned ON;

detecting means for detecting the temperature of the heating roller along with the elapse of time; and judging means for judging presence of error by comparing a time elapsed to the temperature arriving points at plural stages judged according to detected temperature by the detecting means and the reference times that are read out from the storing means by the second reading means.

4. An image forming apparatus that is capable of setting various options, having a coil in a heating roller, generating eddy-current in the heating roller by generating a high frequency magnetic field from the coil and a fixing device to fix a developer image on a recording medium by the self-heating of the heating roller based on the eddy-current loss, comprising:

first judging means for judging the electric power to be applied to the coil when executing the warming-up process to raise the temperature of the heating roller to a prescribed temperature when the power source is turned ON based on the set options;

second judging means for judging the electric power to be applied to the coil when executing the pre-run process to rotate the heating roller after the warming-up process based on the set options;

third judging means for judging a comparative time until the temperature arriving points at plural stages when executing the warming-up process to raise the temperature of the heating roller to a prescribed temperature and the subsequent pre-run process based on the electric power judged by the first and second judging means based on the set options;

processing means for executing the warming-up process to raise the temperature of the heating roller to a prescribed temperature by applying the electric power of the electric power judged by the first judging means when the power source is turned ON and the pre-run process to rotate the heating roller in the state of heating the heating roller by applying the electric power of the electric power judged by the second judging means after the warming-up process;

detecting means for detecting the temperature of the heating roller along with the elapse of time at the time of processing by the processing means; and fourth judging means for judging presence of error according to the time elapse to the temperature arriving points at plural stages judged by the temperatures detected by the detecting means and a corresponding comparative time judged by the third judging means.

5. The image forming apparatus according to claim 4, further comprising:

storing means for pre-storing the electric power to be applied to the coil when executing the warming-up processes that are different corresponding to the set state of various options;

wherein the first judging means makes the judgment based on contents stored in the storing means.

6. The image forming apparatus according to claim 4, further comprising:

storing means for pre-storing comparative times until the temperature arriving points at plural stages when executing the warming-up processes that are different corresponding to the set state of various options;

wherein the second judging means makes the judgment based on contents stored in the storing means.

7. An image forming apparatus that is capable of setting various options, has a coil in a heating roller, generates eddy-current in the heating roller by generating a high frequency magnetic field from the coil and a fixing device to fix a developer image on a recording medium by the self-heating of the heating roller based on the eddy-current loss, comprising:

storing means for pre-storing electric power data corresponding to electric power being applied to the coil when executing warming-up processes that are different corresponding to the set state of various options and pre-storing reference times until temperature arriving points at plural stages when executing warming-up processes that are different corresponding to the set state of various options;

first reading means for reading out from the storing means the electric power data corresponding to the electric power to be applied to the coil when executing the warming-up process to raise the temperature of the heating roller to a prescribed temperature when a power source is turned ON based on the set options;

second reading means for reading out from the storing means the electric power data corresponding to the electric power to be applied to the coil when executing the pre-run process to rotate the heating roller after the warming-up process based on the set options; and processing means for executing the warming-up process to raise the temperature of the heating roller to a prescribed temperature by applying the electric power corresponding to the electric power data read out from the storing means by the first reading means when the power source is turned ON and for executing the pre-run process to rotate the heating roller in the state of heating the heating roller by applying the electric power corresponding to the electric power data read out from the storing means by the second reading means after the warming-up process.

8. In an image forming apparatus that is capable of setting various options, has a coil in a heating roller, generates eddy-current in the heating roller by generating a high frequency magnetic field from the coil and has a fixing device to fix a developer image on a recording medium by the self heating of the heating roller based on the eddy-current loss, an error detecting method when supplying the electric power to the heating device, comprising:

storing, in a memory, electric power data corresponding to electric power being applied to the coil that are different corresponding to the set state of various options and storing reference times until temperature arriving points at plural stages that are different corresponding to the set state of various options;

reading out from the memory the electric power data corresponding to the electric power being applied to the coil and the reference times to the temperature reaching points at plural stages when executing the process to raise the temperature of the heating roller to a prescribed temperature when a power source is turned ON based on the set options;

executing the process to raise the temperature of the heating roller to a prescribed temperature by applying the electric power to the coil when the power source is turned ON, wherein the electric power corresponds to the electric power data read out from the memory by the reading step based on the set option;

detecting the temperature of the heating roller along with the lapse of time when executing the process; and judging presence of error by comparing a time elapsed to the temperature arriving points at plural stages judged according to the detected temperature and the reference times that are read out from the memory.

9. The error detecting method according to claim 8, wherein the processing steps described correspond to the warming-up process to raise the temperature of the heating roller to a prescribed temperature when the power source is turned ON or the warming-up process to raise the temperature of the heating roller to a prescribed temperature when the power source is turned ON and the pre-run process to rotate the heating roller after the warming-up process.

10. In an image forming apparatus that is capable of setting various options, has a coil in a heating roller, generates eddy-current in the heating roller by generating a high frequency magnetic field from the coil and has a fixing device for fixing a developer image on a recording medium by the self-heating of the heating roller based on the eddy-current loss, an error detecting method when supplying electric power to the heating device, an error detecting method comprising:

storing, in a memory, electric power data corresponding to electric power being applied to the coil when executing warming-up processes that are different corresponding to the set state of various options and storing reference times until temperature arriving points at plural stages when executing warming-up processes that are different corresponding to the set state of various options;

firstly reading out from the memory the electric power data corresponding the electric power to be applied to the coil when executing the warming-up process to raise the temperature of the heating roller to a prescribed temperature when a power source is turned ON based on the set options;

secondly reading out the reference times until the temperature arriving points are reached at plural states when executing the warm-up process to raise the temperature of the heating roller to a prescribed temperature when the power source is turned ON based on the set options;

executing the warming-up process to raise the temperature of the heating roller to a prescribed temperature by applying the electric power corresponding to the electric power data read out by the firstly reading step when the power source is turned ON;

detecting the temperature of the heating roller along with the elapse of time during the process according to the executing step; and judging presence of error by comparing a time elapsed to the temperature arriving points at plural stages judged by the detected temperature in the detecting step and the reference times that are read out from the memory in the secondly reading step.

11. In an image forming apparatus that is capable of setting various options, has a coil in a heating roller, generates eddy-current in the heating roller by generating a high frequency magnetic field from the coil and has a fixing device for fixing a developer image on a recording medium by the self-heating of the heating roller based on the eddy-current loss, an error detecting method for detecting any error when supplying electric power to the heating device, comprising:

firstly judging the electric power to be applied to the coil when executing the warming-up process to raise the temperature of the heating roller to a prescribed temperature when the power source is turned ON based on the set options;

secondly judging the electric power to be applied to the coil when executing the pre-run process to rotate the heating roller after the warming-up process based on the set options;

thirdly judging a comparative time to the temperature arriving points at plural stage when executing the warming-up process to raise the temperature of the heating roller and the subsequent pre-run process based on the electric power judged in the firstly and secondly judging step based on the set options;

executing the warming-up process to raise the temperature of the heating roller to a prescribed temperature by applying the electric power of the electric power judged by the firstly judging step when the power source is turned ON and the pre-run process to rotate the heating roller by applying the electric power of the electric power judged in the secondly judging step after the warming-up process;

detecting the temperature of the heating roller along with the elapse of time during the process in the executing step; and fourthly judging whether there is any error according to the time elapse to the temperature arriving points at plural stages judged by the detected temperature in the detecting step and a corresponding comparative time judged in the thirdly judging step.

12. In an image forming apparatus that is capable of setting various options, has a coil in a heating roller, generates eddy-current in the heating roller by generating a high frequency magnetic field from the coil and has a fixing device for fixing a developer image on a recording medium by the self-heating of the heating roller based on the eddy-current loss, a method for supplying electric power to the heating device, comprising:

storing, in a memory, electric power data corresponding to electric power being applied to the coil when executing warming-up processes that are different corresponding to the set state of various options and storing reference times until temperature arriving points at plural stages when executing warming-up processes that are different corresponding to the set state of various options;

firstly reading out from the memory the electric power data corresponding to the electric power to be applied to the coil when executing the warming-up process to raise the temperature of the heating roller to a prescribed temperature when a power source is turned ON based on the set options;

secondly reading out from the memory the electric power data corresponding to the electric power to be applied to the coil when executing the pre-run process to rotate the heating roller after the warming-up process based on the set options; and executing the warming-up process to raise the temperature of the heating roller to a prescribed temperature by applying the electric power corresponding to the electric power data read out from the memory in the firstly reading step when the power source is turned ON and the pre-run process to rotate the heating roller in the state of heating the heating roller by applying the electric power corresponding to the electric power data read out from the memory in the secondly reading step after the warming-up process.

13. An image forming apparatus capable of setting various options, comprising:

a fixing device including a coil in the heating roller, generates eddy-current in the heating roller by generating a high frequency magnetic field from the coil and fixing a developer image on a recording medium by the self-heating of the heating roller based on the eddy-current loss;

a memory to store electric power data corresponding to electric power being applied to the coil that are different corresponding to the set state of various options and store reference times until temperature arriving points at plural stages that are different corresponding to the set state of various options;

a temperature detector to detect the temperature of the heating roller along with the elapse of time; and a processing unit configured to;

read out from the memory the electric power data corresponding to the electric power being applied to the coil and the reference times until the temperature arriving points at plural stages when executing the process to raise the temperature of the heating roller to a prescribed temperature when the power source is turned ON based on the set option, execute the process to raise the temperature of the heating roller to a prescribed temperature by applying the electric power to the coil when the power source is turned ON, wherein the electric power corresponds to the electric power data read out from the memory based on the set option, and judge presence of error by comparing a time elapsed to the temperature arriving points at plural stage judged according to detected temperatures by the detector along with the elapse of time and the reference times that are read out from the memory.

14. The image forming apparatus according to claim 13, wherein the processing unit corresponds to the warming-up process to raise the temperature of the heating roller to a prescribed temperature when the power source is turned ON or the warming-up process to raise the temperature of the heating roller to a prescribed temperature when the power source is turned ON and the pre-run process to rotate the heating roller after the warm-up process.

* * * * *